US006544626B1

(12) United States Patent
Minges

(10) Patent No.: US 6,544,626 B1
(45) Date of Patent: Apr. 8, 2003

(54) NATURAL GRIP

(76) Inventor: Donald L. Minges, 10224-B Plum Creek Dr., Charlotte, NC (US) 28210

( * ) Notice: Subject to any disclaimer, the term of this patent is extended or adjusted under 35 U.S.C. 154(b) by 1841 days.

(21) Appl. No.: 08/525,495

(22) Filed: Sep. 5, 1995

Related U.S. Application Data

(63) Continuation of application No. 08/165,812, filed on Dec. 13, 1993, now abandoned.

(51) Int. Cl.[7] ..... A43B 13/26

(52) U.S. Cl. ..... 428/141; 36/28; 36/59 R; 36/59 C; 428/152; 428/156; 428/167; 428/187; D2/902; D2/951

(58) Field of Search ..... 428/141, 152, 428/156, 167, 187; 36/28, 59 R, 59 C; D2/320, 321

(56) References Cited

U.S. PATENT DOCUMENTS

| | | | | |
|---|---|---|---|---|
| 3,402,485 A | 9/1968 | McMorrow | 36/25 |
| D247,832 S | 5/1978 | Glasgow | D2/4 |
| 4,266,349 A | 5/1981 | Schmohl | 36/32 R |
| 4,494,321 A | 1/1985 | Lawlor | 36/28 |
| D287,903 S | 1/1987 | Jones | D2/321 |
| 4,697,361 A | 10/1987 | Ganter | 36/28 |
| D295,114 S | 4/1988 | Horne | D2/321 |
| D304,390 S | 11/1989 | Nakano | D2/320 |
| D309,670 S | 8/1990 | Mendonca | D2/321 |
| D319,338 S | 8/1991 | Nakano | D2/321 |
| D337,428 S | 7/1993 | Allen, III | D2/320 |
| 5,465,507 A | 11/1995 | Schumacher | 36/30 R |

*Primary Examiner*—Nasser Ahmad
(74) *Attorney, Agent, or Firm*—Dougherty, Clements & Hofer

(57) ABSTRACT

A gripping and traction pattern for use on the outer gripping surfaces of footwear, handwear, tools, and the like that provides increased traction and a more natural feel. The pattern has a tread pattern of multiple projections extending from the base of the gripping surface, the projections being of a shape, contour, and arrangement corresponding to the anatomical characteristics of a human or animal foot, hand, or paw.

5 Claims, 8 Drawing Sheets

NATURAL GRIP

CROSS-REFERENCE TO RELATED APPLICATION

This application is a continuation application of co-pending U.S. patent application No. 08/165,812, filed Dec. 13, 1993, and now abandoned.

FIELD OF THE INVENTION

The present invention relates to gripping and traction surfaces and patterns, particularly for attachment to footwear, handwear, and tools, and more particularly to a shoe sole or glove with an improved pattern having the shape and configuration of the bottom of a human foot or a human hand, respectively.

BACKGROUND OF THE INVENTION

It is known in the art to provide a traction or gripping surface made of an elastically deformable and compressible material having a tread pattern of differing shapes and designs to improve the traction of the device to which it is attached, specifically shoe soles, gloves, and mechanical gripping devices. Heretofore, shoe soles have included varying patterns of geometric shapes. During the act of walking or running, the anatomy of the bare human foot, with its numerous curves, contours, and recesses, provides superior traction and gripping ability. Therefore, the need for a sole with an outer surface that very closely approximates the anatomy of a human foot is evident. Previous attempts to provide such a sole have proven inadequate.

DESCRIPTION OF THE PRIOR ART

Applicant is aware of the following patents pertaining to footwear soles and insoles:

| Patent No. | Issue Date | Inventor | Title |
|---|---|---|---|
| Des. 247,832 | May 9, 1978 | Glasgow | SHOE BOTTOM UNIT |
| Des. 287,903 | Jan. 27, 1987 | Jones | SHOE SOLE |
| Des. 295,114 | Apr. 12, 1988 | Horne | SHOE SOLE |
| Des. 304,390 | Nov. 7, 1989 | Nakano | SHOE SOLE |
| Des. 309,670 | Aug. 7, 1990 | Mendonca | SHOE SOLE |
| Des. 319,338 | Aug. 27, 1991 | Nakano | SHOE SOLE |
| Des. 337,428 | Jul. 20, 1993 | Allen | SHOE OUTSOLE |
| 3,402,485 | Sep. 24, 1968 | McMorrow | ANIMAL TRACK FOOTWEAR SOLES |
| 4,266,349 | May 12, 1981 | Schmohl | CONTINUOUS SOLE FOR SPORTS SHOE |
| 4,494,321 | Jan. 22, 1985 | Lawlor | SHOCK RESISTANT SHOE SOLE |
| 4,697,361 | Oct. 06, 1987 | Ganter | BASE FOR AN ARTICLE OF FOOTWEAR |

Glasgow, U.S. Design Pat. No. 247,832, teaches an ornamental foot-shaped design for a shoe bottom.

Jones, U.S. Design Pat. No. 287,903, teaches an ornamental design for a shoe sole, which looks like an animal paw.

Horne, U.S. Design Pat. No. 295,114, teaches another ornamental foot-shaped design for a shoe sole.

Mendonca, U.S. Design Pat. No. 309,670, teaches a further ornamental foot-shaped design of a shoe sole.

McMorrow, U.S. Pat. No. 3,4022,485, is directed to footwear that lays simulated animal tracks, which are incorporated into the sole.

Schmohl, U.S. Pat. No. 4,266,349, teaches a continuous sports shoe outsole that includes generally circular pattern elements in the ball and heel areas of the shoe sole to facilitate rotation of the foot. These pattern elements are roughly based on the arrangement of elements of the human foot.

Ganter U.S. Pat. No. 4,697,361, teaches a footwear base made of elastically compressible material which yields in response to the application of stresses by the foot of the wearer of the shoe.

The remaining patents listed show similar shoe sole designs, and are included for the sake of completeness.

SUMMARY OF THE INVENTION

The present invention embodies the ultimate in the ergonomic design of a gripping and traction surface. The present invention is a device to enhance the gripping or traction of articles to which it is formed or attached, namely footwear, handwear, and mechanical gripping or traction devices. More particularly, the device is a gripping and traction pattern, formed as an integral part of a shoe sole, that is based on the natural footprint of a human foot. The bottom of the human foot is not a flat surface, but a combination of various anatomical elements of differing size, shape, and contour. The present invention is molded as an integral part of an elastically deformable and compressible outsole, and incorporates the elements and characteristics of the human foot. The sole has multiple projections which stand away from the base of the sole, thereby creating adjacent raised and recessed areas. Projections corresponding to the five toes, and large projections approximating the ball and heel of the foot, are formed in proportion to the actual anatomy of the human foot, thereby creating projections of varying heights. These projections create recessed areas corresponding to the areas between and behind the toes as well as other recessed areas of the human footprint. These recessed areas allow the ground-engaging projections to adequately deform depending on the force exerted on the sole by the wearer. The outer surface of the outsole is textured with small ridges to approximate the skin pattern of the human foot to further improve traction.

Additionally, the invention can be used for the outer gripping surfaces of gloves or mechanical gripping devices. The palm and finger surfaces of gloves are covered with a thin, elastically deformable material incorporating the shape, contour, and features of the human handprint. The present invention is envisioned not only to be applicable to shoe soles and gloves for wear by humans, but also to the makers and users of movable automated equipment, such as robots, where gripping traction is desired. Additionally, the inventive concept can be expanded to provide devices for superior traction and gripping power for numerous applications, such as gripping tools, prostheses, or any other similar device.

OBJECTS OF THE INVENTION

The principal object of the invention is to enhance the gripping or traction of articles to which it is formed or attached, namely footwear, handwear, and mechanical gripping or traction devices.

A further object of the invention is to provide a gripping and traction pattern for a sole of an article of footwear that approximates the shape and contour of the bottom of a foot.

A still further object of the invention is to provide a gripping and traction pattern for a shoe sole having tread features that provide superior traction.

A still further object of the invention is to provide a gripping and traction pattern for a shoe sole that gives a more comfortable and natural feel to the wearer.

Another object of the invention is to provide an outer surface for an article of handwear that approximates the shape and arrangement of a human hand or an appendage of a creature of the class Mammalia.

A further object of the invention is to provide a surface pattern for a glove having features that provide superior gripping ability and a more comfortable and natural feel to the wearer.

Another object of the invention is to provide a gripping and traction pattern corresponding to the anatomy of a hand, foot, paw or similar appendage of any a creature of the class Mammalia.

Another object of the invention is to provide a surface pattern corresponding to the anatomy of a human hand for use on mechanical gripping devices for increased traction and gripping ability.

BRIEF DESCRIPTION OF THE DRAWINGS

The foregoing and other objects will become more readily apparent by referring to the following detailed description and the appended drawings in which.

DETAILED DESCRIPTION OF THE PREFERRED EMBODIMENT

Figure 1:
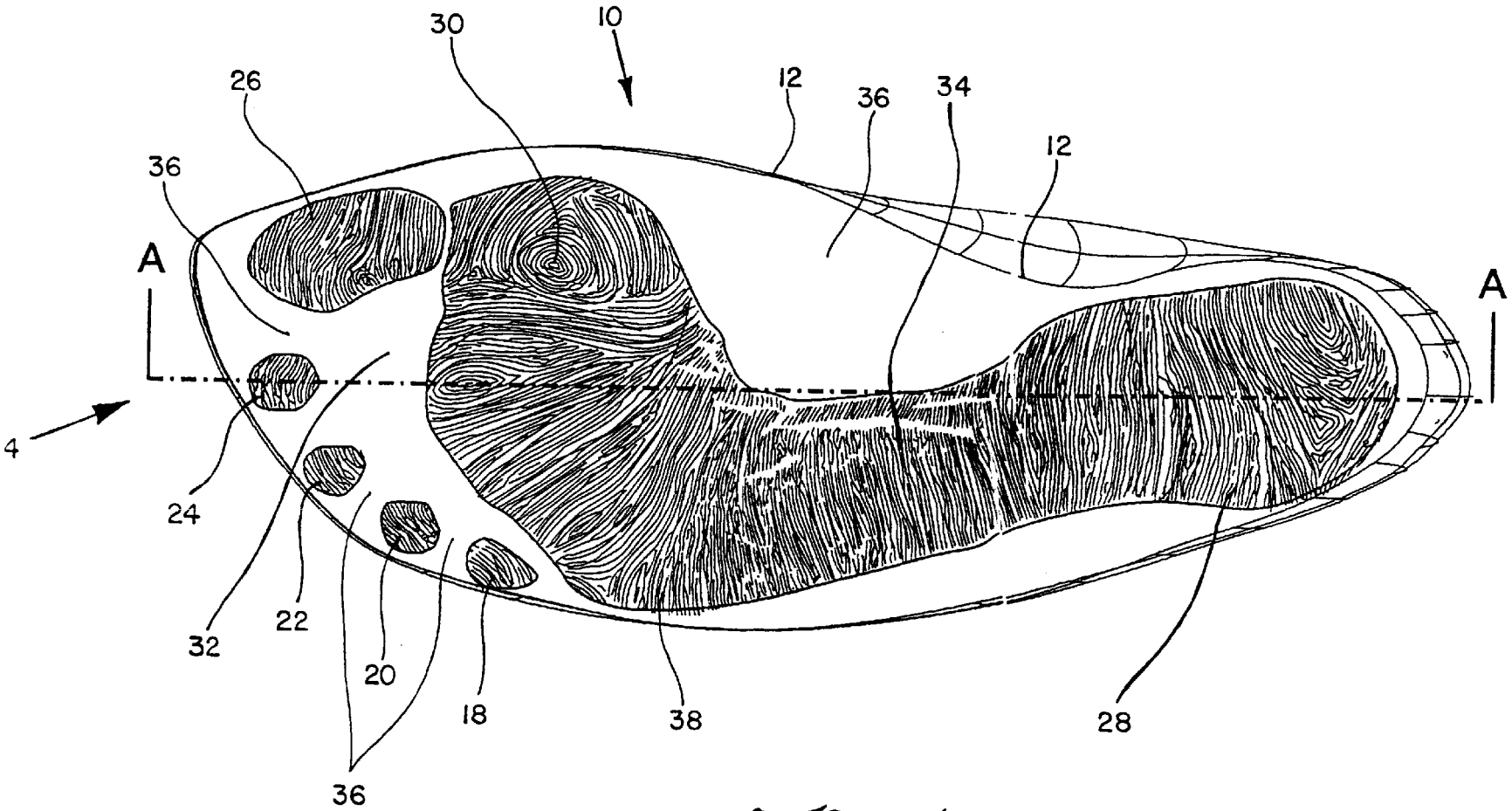
FIG. 1 is a plan view of a sole of a shoe in accordance with the present invention.
Figure 2:
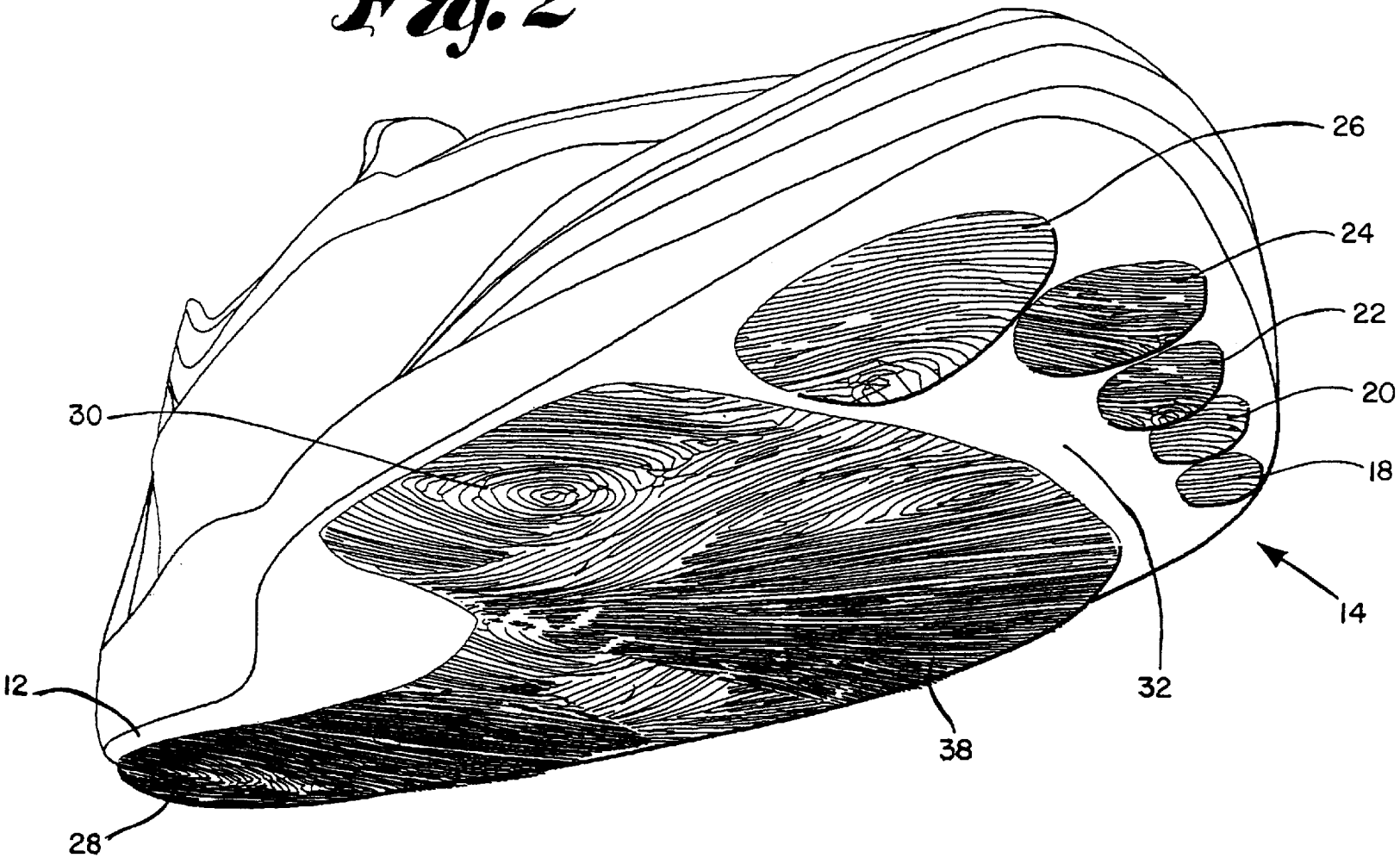
FIG. 2 is an isometric view of the shoe of FIG. 1 having a sole embodying the present invention.
Figure 3:
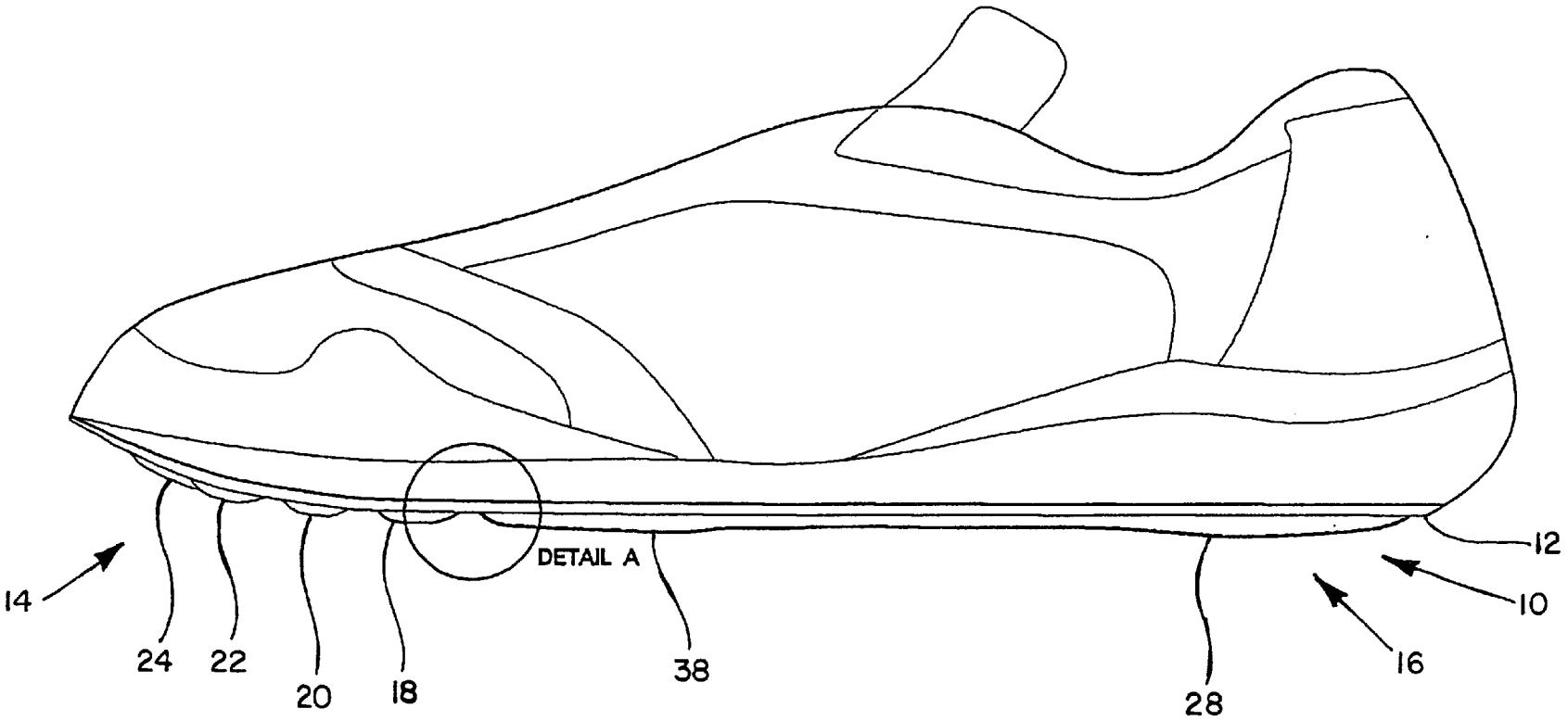
FIG. 3 is a side view of the shoe of FIG. 1 having a sole embodying the present invention.

FIGS. 1, 2, and 3 shows a shoe sole 10 constructed from an elastically deformable material. The sole has a base surface 12 that is substantially smooth and flat with a front portion 14 corresponding to the toe area of the sole and a rear portion 16 corresponding to the heel area of the sole. Molded as an integral part of the sole are projections 18, 20, 22, 24, 26, 28, 30 which extend beyond the base surface 12 in varying shapes, contours, and heights.

FIG. 1 shows, at the front portion of the sole 14 , five projections 18, 20, 22, 24, 26 the size, shape, and location of which correspond to that of the bottom tips of the toes of a human foot. Other large projections 28, 30 cover a substantial part of the sole, from the heel area to the area of the sole corresponding to the ball of the foot.

Figure 5:
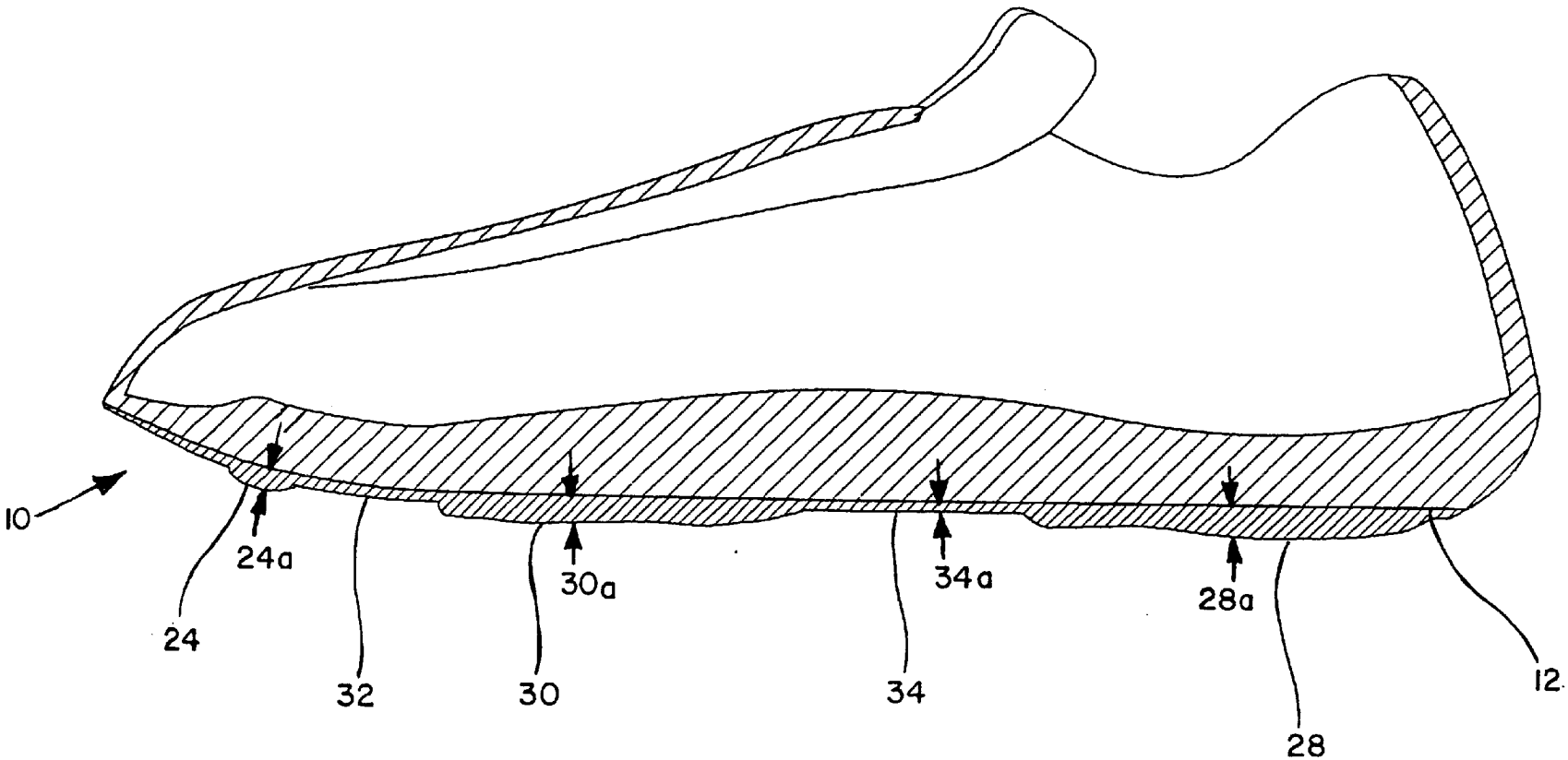
FIG. 5 is a cross-sectional view of the sole taken along line A—A of FIG. 1.

The projections are not necessarily uniform in the heights 24*a*, 28*a*, 30*a* by which they extend from the base surface 12, as seen in FIG. 5. The height of any projection varies in relation to the variation in the three-dimensional anatomy of the human foot. The variation in projection height can also be based on the respective magnitude of force applied to the respective areas of the sole during walking or athletic activity. For example, the projection height 28*a* at the heel is greater than the projection height 34*a* at the instep. This variation in projection height, based on the anatomy of the foot, results in some areas on the outsole where little or no projection occurs, leaving gaps and recesses 32, 36 as shown in FIG. 1. These recessed areas 32, 36 correspond to the areas of a human foot that do not necessarily directly contact the ground when a person is standing, such as the instep, and the areas between and behind the toes. These recessed areas of the human foot are very important to the acts of walking or running, however, because they allow the toes to grip the ground or floor surface when force is applied when walking, thereby creating superior traction. Similarly, the recesses 32, 36 in the invented sole allow the ground-engaging projections to adequately deform based on the force or stress applied by the wearer of the shoe. This deformation also supplies superior traction and a more natural feel for the wearer of the shoe.

Figure 4:
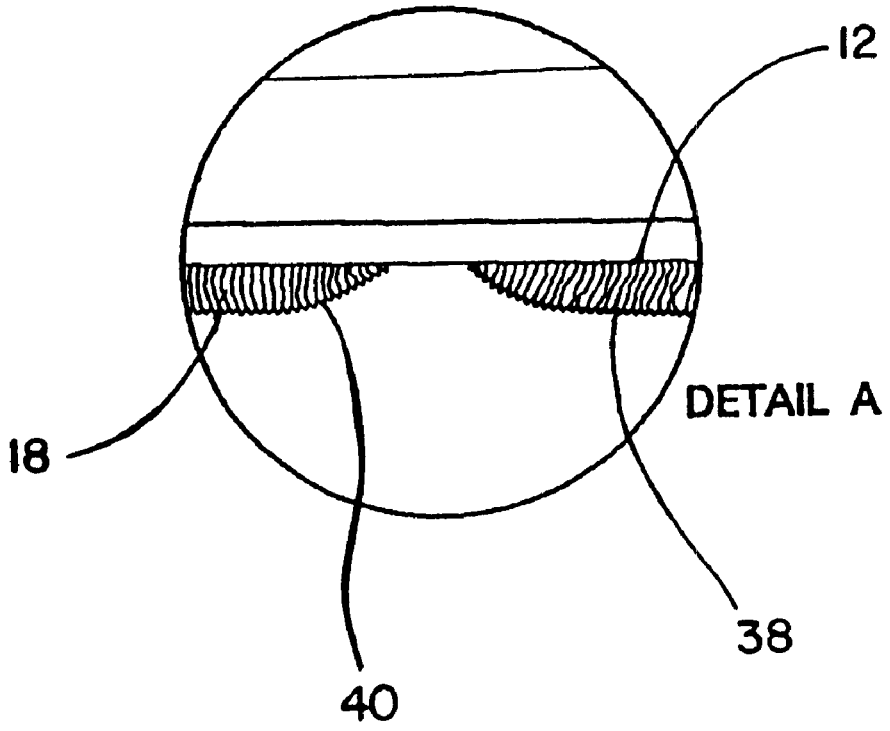
FIG. 4 is an enlarged side view of a portion of the sole of FIG. 3 showing the surface texture of the sole.

FIG. 4 shows an enlarged view of the outer surface of the projections 18, 38. Integrally formed on all ground-engaging outer surfaces of all projections are a plurality of small ridges 40 that simulate the characteristic print of human skin. These ridges allow the ground-engaging surfaces of the elastically deformable sole to better grip the walking platform thereby creating superior traction.

The best mode of carrying out the invention is accomplished where the gripping and traction surface is an integral part of the shoe sole, which is constructed of an elastically deformable material that is common to athletic shoes, such as rubber, PVC, polyurethane, or any suitable synthetic plastic substance. The sole is cast or injection molded directly to the upper of the shoe to integrally incorporate all of the features of the gripping pattern, including the base, projections, recesses, and ridges.

ALTERNATIVE EMBODIMENTS

The present invention can be applied not only to footwear to be worn by humans, but also to any application where gripping traction is required, such as on gloves, tools, or leg or arm members of automated machinery or robots. The development of technologically advanced machinery capable of carrying out mechanical tasks continues to expand. The invented gripping and traction pattern can be attached to any element of a device or machine in which superior gripping ability or traction is desired.

FIGS. 6–11 show other embodiments including the use of hand or finger-shaped projections on the gripping surfaces of gloves or other gripping devices, such as the mechanical hands of robots, automated machinery, or gripping tools.

Figure 12:
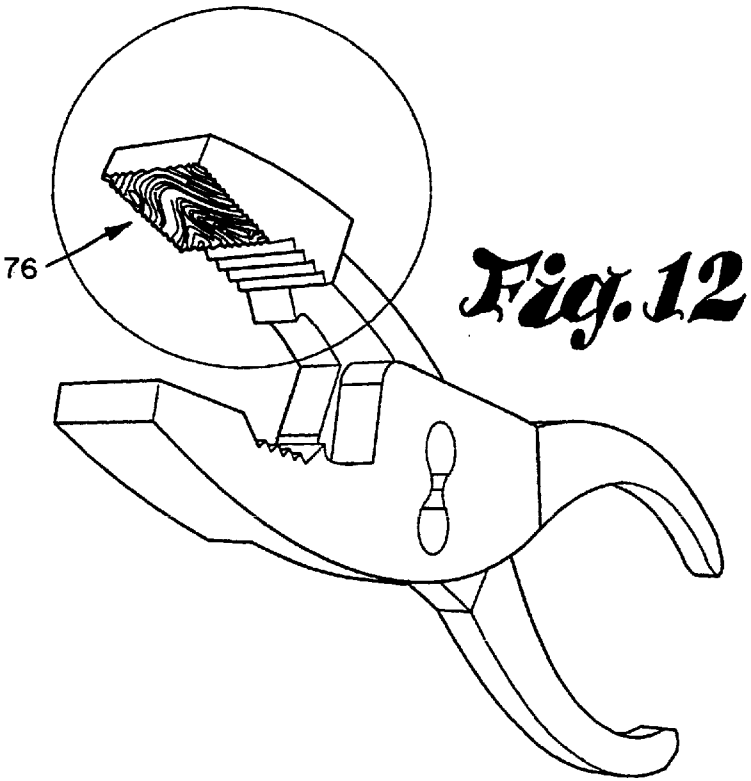
FIG. 12 is an isometric view of another mechanical gripping device having gripping surface patterns embodying the present invention.
Figure 13:
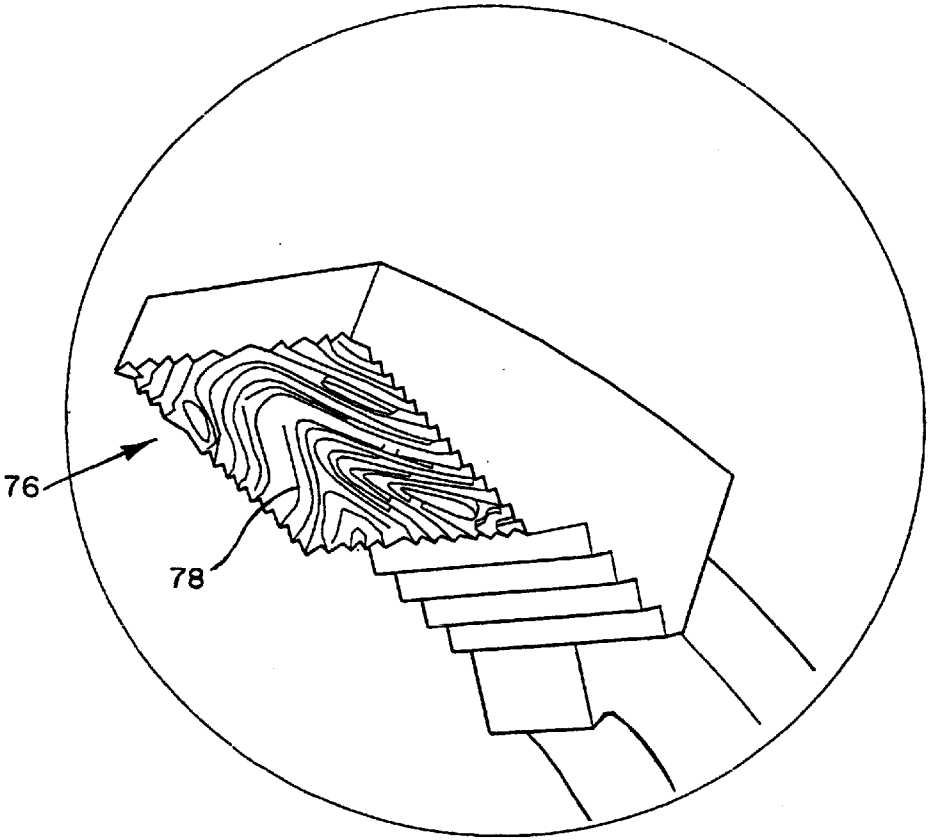
FIG. 13 is an enlarged isometric view of a portion of a mechanical gripping device showing the surface texture (exaggerated).

FIGS. 12 and 13 show another embodiment of the invention as applied to the gripping surface of a mechanical device. The device has ridges 78 formed directly on its gripping surfaces 76, and does not have projections formed on its surfaces. These ridges 78 are formed in a configuration which approximates the characteristic print of human skin.

Figure 6:
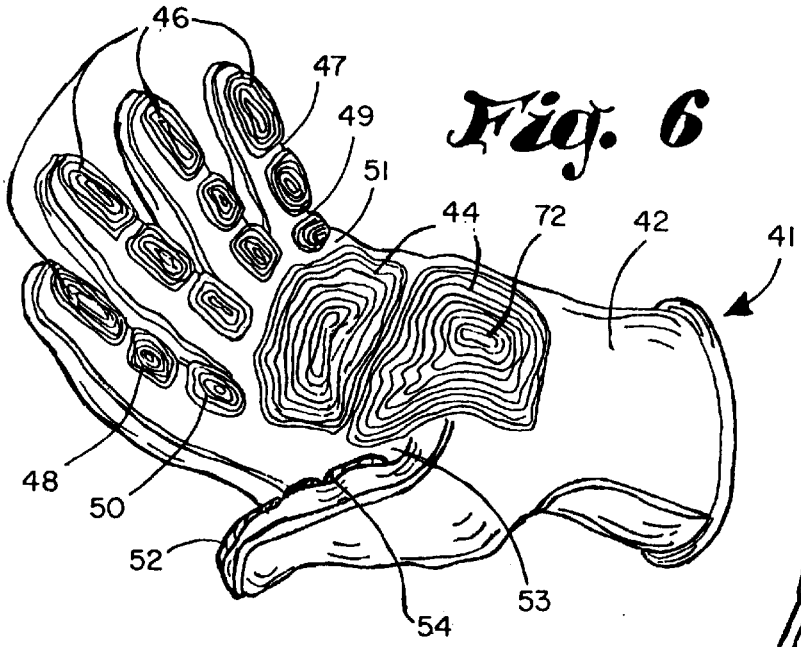
FIG. 6 is an isometric view of a glove having a gripping surface pattern embodying the present invention.

FIG. 6 shows a glove 41 with a base surface 42. Extending beyond the base surface 42 are multiple projections corresponding to the shape and contour of the palm and fingers of the human hand. Palm projections 44 cover a portion of the surface of the glove corresponding to the human palm. On each of the four finger portions of the glove are separate and distinct projections 46, 48, 50 corresponding to the three segments of each human finger formed by a knuckle and two joints. Projections 52 and 54, similar in shape and arrangement to the inner surface of the human thumb, extend from the base surface 42 of the thumb portion of the glove.

Because these projections are separate and distinct, gaps 47, 49, 51, 53 are created on the areas of the glove surface between projections. These gaps allow proper closure of the glove around an object to be grasped and allow adequate deformation of the deformable projection surfaces, thereby creating superior traction and gripping ability.

Figure 7:
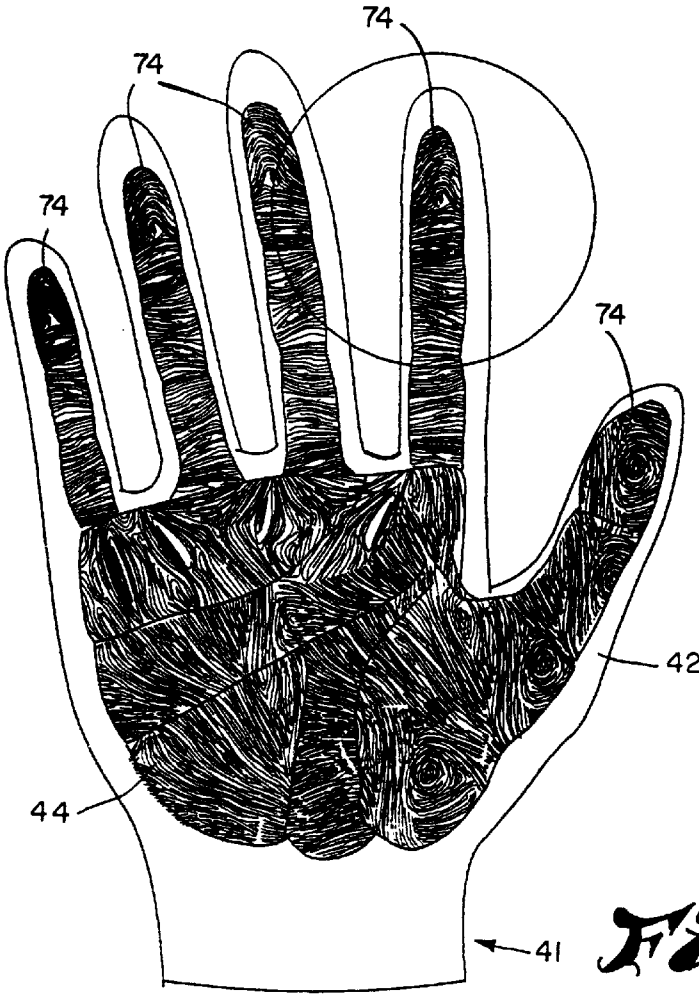
FIG. 7 is a plan view of a glove having an alternative gripping surface pattern embodying the present invention.
Figure 8:
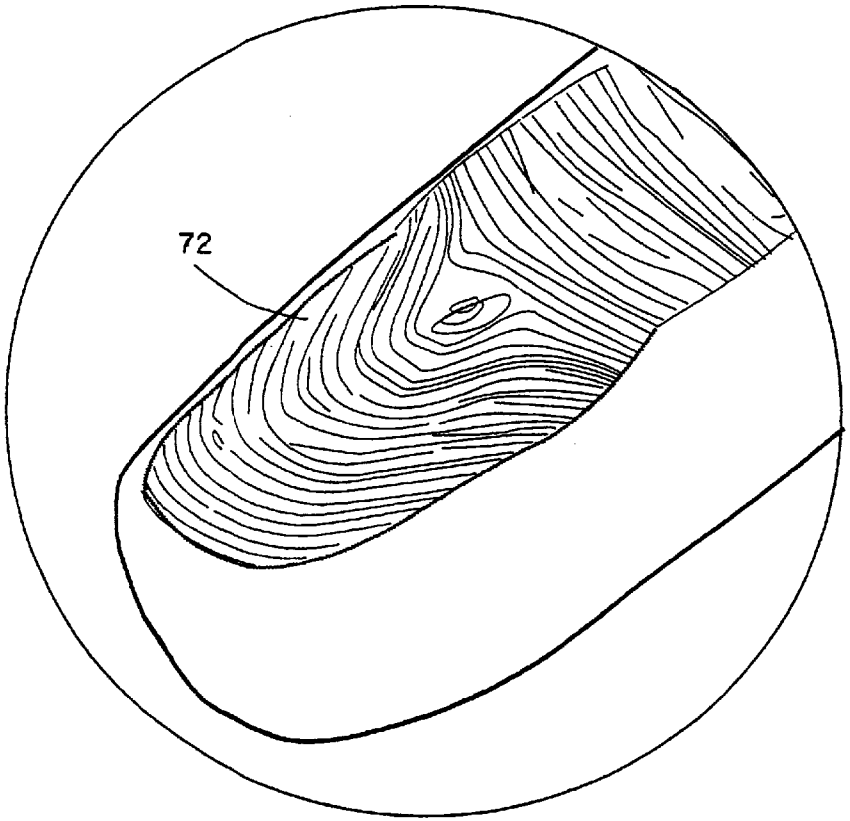
FIG. 8 is an enlarged isometric view of a finger portion of a glove showing the surface texture of the glove.

Alternatively, the projections extending from the base surface 42 of the glove 41 may not be separate and distinct, but may be unitary, as shown in FIG. 7. A large, single projection 74 extends from the base surface 42 of the glove 41. This projection corresponds to the shape and configuration of a human hand. The outer surface of projection 74 has integrally formed ridges 72 that are arranged in a manner simulating the characteristics of human skin. Similarly, the projections extending from the base surface 12 of the shoe sole 10 may not be separate and distinct, but may be unitary and comprise a single large projection which approximates the size, shape, and arrangement of a human foot.

Figure 9:
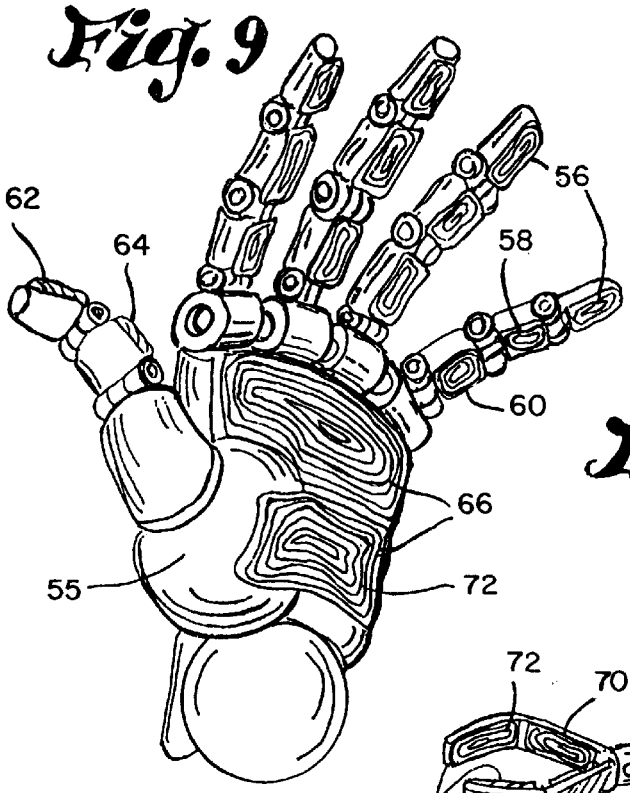
FIG. 9 is an isometric view of a mechanical device simulating a human hand having a gripping surface pattern embodying the present invention.

FIG. 9 shows a mechanical hand as would be used with a robot or a piece of automated machinery. Projections 56, 58, 60, made of any suitable elastically deformable and compressible material, such as that used for athletic shoe soles, and attached to the mechanical hand by an adhesive, extend beyond the surface 55 of the hand. These projections 56, 58, 60 correspond to the shape and arrangement of human fingers. Similarly, projections 66 corresponding to the shape and size of the palm are attached to the palm portion of the mechanical hand, and projections 62, 64 approximating the shape of a human thumb are attached to the mechanical hand and extend beyond the surface 55 of the mechanical hand.

Figure 10:
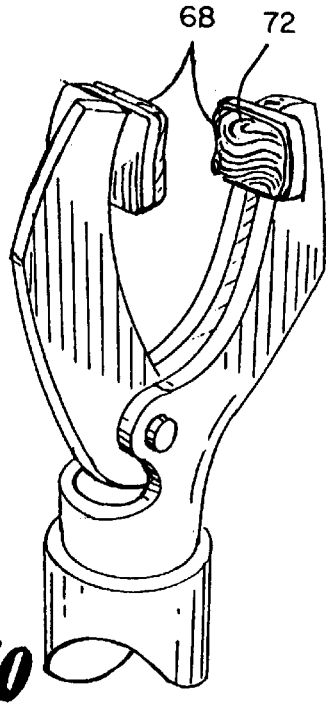
FIG. 10 is an isometric view of an alternative mechanical gripping device having a gripping surface pattern embodying the present invention.
Figure 11:
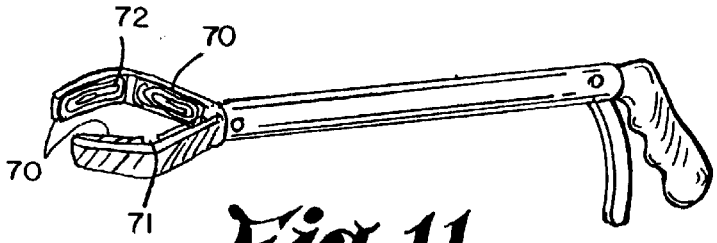
FIG. 11 is an isometric view of another mechanical gripping device having a gripping surface pattern embodying the present invention.

FIG. 11 shows a mechanical gripping device with projections 70 approximating the shape of human fingers adhesively attached to the gripping surfaces of the tool. The projections, made of any suitable elastically deformable material, do not cover the entire portion of the gripping surface, thereby leaving gaps 71. These gaps 71 effect proper closure of the gripping mechanism around the object to be grasped. FIG. 10 discloses another mechanical gripping mechanism. The gripping surfaces are covered with an elastically deformable material 68 to create the requisite gripping ability.

FIGS. 6–11 show that on all outer surfaces of all projections are integrally formed a plurality of ridges 72. These ridges allow adequate deformation of the elastic projection material when force is applied to their surfaces, thereby creating superior traction and gripping ability. These ridges are formed and arranged in a pattern which approximates the swirls, whorls, loops, or other characteristics of human skin.

The ridges 40, 72 formed on all gripping and traction surfaces described are not necessarily spaced evenly on each projection nor are the ridges necessarily uniform in their width or depth. Additionally, these ridges can be arranged in a manner simulating the skin characteristics of an appendage of a creature of the class Mammalia not merely those of human skin.

Another embodiment of the invention involves arranging the ridges on the gripping and traction surfaces of the projections in a pattern of concentric circles, concentric ovals, spirals, or other geometric configurations.

Similarly, the present invention can provide gripping and traction surfaces with projections arranged corresponding to the anatomy of a foot, hand, finger, paw, claw, or any surface-engaging appendage of a creature of the class Mammalia. Further, the material of which the present invention is formed need not be elastically deformable. The gripping and traction pattern can be formed of any material suitable for use on the article to which it is to be attached; for example, the pattern for use on the sole of a shoe can be made of leather.

SUMMARY OF THE ACHIEVEMENT OF THE OBJECTS OF THE INVENTION

From the foregoing, it is readily apparent that I have invented a surface or pattern which enhances the gripping or traction of articles to which it is formed or attached, namely footwear, handwear, and mechanical gripping or traction devices, and which provides a more natural and comfortable feel for the wearer. Similarly, I have invented an improved surface for the gripping or traction portion of a shoe, glove, or mechanical gripping device which provides superior gripping ability and a natural feel.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A gripping and traction surface comprising:

a generally planar base; and a plurality of projections depending substantially perpendicularly from said base, each of said plurality of projections corresponding to an anatomical characteristic of a human appendage, wherein the human appendage is a hand.

2. A surface according to claim 1 wherein said plurality of projections correspond to the fingers and palm of the human hand.

3. A surface according to claim 1 wherein said base and said plurality of projections define the gripping surface of a glove.

4. A surface according to claim 1 wherein said base and said plurality of projections define the gripping surface of a mechanical tool.

5. A gripping and traction surface comprising:

a generally planar base; and a plurality of projections depending substantially perpendicularly from said base, each of said plurality of projections corresponding to an anatomical characteristic of a human appendage, wherein said surface is the hand of a robot.

* * * * *